US005327919A

United States Patent [19]

Hanlon

[11] Patent Number: 5,327,919

[45] Date of Patent: Jul. 12, 1994

[54] WATER EXTRACTION DEVICE

[76] Inventor: John F. Hanlon, 618 Greentree La., Jeffersonville, Pa. 19403

[21] Appl. No.: 896,677

[22] Filed: Jun. 10, 1992

[51] Int. Cl.[5] ..... A45D 19/18

[52] U.S. Cl. ..... 132/270; 132/212; 132/228

[58] Field of Search ..... 132/212, 228, 270, 271, 132/272; 15/314, 330, 344; 34/96, 97, 99

[56] References Cited

U.S. PATENT DOCUMENTS

| | | | |
|---|---|---|---|
| 1,982,684 | 12/1934 | Meier et al. | 132/228 |
| 2,049,035 | 7/1936 | Wilsey | 132/228 |
| 2,232,218 | 2/1941 | Doty | 132/212 |
| 2,668,315 | 2/1954 | Crosby | 15/344 |
| 2,678,376 | 5/1954 | Lockwood | 219/39 |
| 2,753,434 | 7/1956 | Storm, Jr. | 219/39 |
| 3,009,188 | 11/1961 | Martin | 15/330 |
| 3,182,666 | 5/1965 | Watkins | 132/212 |
| 3,213,860 | 10/1965 | Mizell et al. | 132/228 |
| 3,213,861 | 10/1965 | Vitello | 132/228 |
| 3,238,556 | 3/1966 | Martin | 15/330 |
| 3,268,942 | 8/1966 | Rossman | 219/346 |
| 4,005,720 | 2/1977 | Machata | 132/228 |
| 4,210,162 | 7/1980 | Dreyer et al. | 132/271 |
| 4,297,564 | 10/1981 | Bartolac | 219/367 |
| 4,309,595 | 1/1982 | Long et al. | 219/370 |
| 4,602,146 | 7/1986 | Barns et al. | 219/373 |
| 4,706,326 | 11/1987 | Romani | 15/314 |
| 4,905,716 | 3/1990 | Hubbard | 132/270 |
| 4,979,524 | 12/1990 | Anderson | 132/272 |

FOREIGN PATENT DOCUMENTS

| | | | |
|---|---|---|---|
| 1060405 | 4/1954 | France | 132/271 |

OTHER PUBLICATIONS

Advertising sheet for "Family Vacuum-Haircutter" produced by Robocut Co., Fort Collins, Colo., Copright 1992.

*Primary Examiner*—Gene Mancene
*Assistant Examiner*—Frank A. LaViola
*Attorney, Agent, or Firm*—Eckert Seamans Cherin & Mellott

[57] ABSTRACT

A water extraction device for partially drying wet hair surrounding a perm rod disposed in a person's hair includes a housing having an inlet and an outlet. The inlet includes a shroud which is dimensioned to closely encompass the perm rod. A motor and fan are provided for producing a substantial vacuum at the inlet and a flow of air from the inlet to the outlet. The substantial vacuum pulls water from the wet hair and the flow of air transports the water toward the outlet. The device further includes one or more water separators for removing the water from the flow of air. The water separated from the air is stored in a holding tank or communicated directly to a plumbing drain. By drawing a flow of air through the wet hair in this manner, surface tension tending to hold water in capillary size passages defined between adjacent hair strands is overcome, thus entraining water droplets in the air flow for collection.

8 Claims, 3 Drawing Sheets

WATER EXTRACTION DEVICE

BACKGROUND OF THE INVENTION

1. Field of the Invention

The invention relates to the field of devices for drying hair, and more particularly, to a device especially adapted for extracting water from wet hair surrounding a perm rod disposed in a person's hair.

2. Prior Art

It is well known to style a person's hair by permanent waving. The permanent waving process involves wrapping the hair around numerous perm rods and adding a perm solution to the hair which causes the hair around the perm rods to take a curled set. The hair is then rinsed with water and partially dried before a neutralization step. The prior art drying method involves blotting the hair with towels in order to absorb the water. Towel blotting, which is usually the initial step in any hair drying process, is slow and difficult when drying hair wrapped on perm rods, because the towel cannot be effectively inserted in the confined spaces between the numerous perm rods. Also, drying of the hair is uneven because the towels make better contact with the hair exposed on top of the rods, so that the hair beneath the rods remains relatively wetter than the hair at the top. An improved apparatus and method for drying wet hair wrapped around perm rods is desirable.

A variety of hair drying devices are known. The hair drying devices typically include means for providing a flow of warm air which is directed through a nozzle toward the wet hair. The flow of warm air greatly increases the rate of water evaporation from the hair. U.S. Pat. Nos. 2,678,376 to Lockwood; 4,297,564 to Bartolac; 4,309,595 to Long et al.; and 4,602,146 to Barns et al. are examples of hand-held hair drying devices which provide a flow of warm air through a nozzle for increasing the rate of water evaporation from wet hair.

Warm air blowing devices also tend to dry the hair unevenly. The upper layers of hair, which are more directly exposed to air flow, are the first to dry, while lower layers residing closer to the scalp or beneath outer layers of hair remain wet or damp after the upper or outer layers are dry. This problem can be alleviated by lifting up the hair with a brush or comb during the drying process in order to expose all the layers of the hair to air flow, more or less evenly. However, when the hair is wrapped around a perm rod, the method of lifting up lower layers of the hair with a comb is not available as long as the perm rods are in place. The warm air blower type dryers cannot effectively dry hair wrapped around perm rods because the inner layers of hair wrapped around the perm rods are shielded from the airflow by the outer layers and remain wet after the outer layers have dried.

The present invention removes water using a vacuum device which engages over a perm rod together with the hair wrapped on the rod. Hair vacuuming devices are known. U.S. Pat. Nos. 2,668,315 to Crosby and 2,753,434 to Storm, Jr. disclose hand-held devices which produce suction for removing hair clippings, dandruff and similar dry foreign matter from a person's hair. These devices have nozzles with protruding fingers which admit air into the suction inlet and also are adapted to massage the scalp for loosening particles while the suction removes the particles from the hair. Neither of these patents contemplates applying suction to the hair for drying purposes, and the nozzles provided with these devices are not adapted to closely encompass a defined body of hair, such as hair wrapped on a perm rod or roller, for drying purposes.

Drying of hair amounts to removing water. When considering the idea of drying an article having a surface, one must distinguish between removing water which is absorbed in the article, water which remains on the surface of the article by surface tension, and excess water which readily flows relative to the article. Insofar as human hair and the like are concerned, hair strands absorb some water and individual strands will retain some water on their surfaces. However, the greater proportion of water in human hair which is wet by a perm solution, rinse water or a similar liquid is either excess flowable water tending to flow by gravity to the lowermost ends of the follicles and to drip off, or is captive water held in the mass of hair by surface tension which holds water between adjacent strands of hair. Adjacent strands lie close enough to one another to define capillary passages which hold the water, and also cause the hair strands to cling to one another. It has been discovered according to the invention that this water held between strands is readily removable by an appropriate form of suction apparatus.

Water or moisture in hair normally is considered to be removable only by blotting or by evaporation, and evaporation can be accelerated by airflow. The present invention provides a device which is especially adapted for extracting water from wet hair wrapped around perm rods on a person's head, i.e., where there is a tendency of water to reside in capillary sized passages between strands. The invention provides a strong suction at an inlet to a housing. The inlet is especially adapted to closely encompass a perm rod for moving air through the capillary passages and overcoming the surface tension which holds the water in place. The invention thus frees water which is held captive along the hair by surface tension by a vacuum applied at the suction inlet and collects the water for reception in a bottle, tank or drain. The vacuum provided at the suction inlet draws air substantially through the mass of hair, thereby extracting the water evenly from all the layers of hair wrapped around the perm rod.

SUMMARY OF THE INVENTION

It is an object of the invention to provide a device for extracting water from wet hair.

It is another object of the invention to provide a device which is especially adapted for extracting water from wet hair wrapped around a perm rod.

It is a further object of the invention to provide a device which extracts water evenly from all layers of wet hair by passing air flow through a mass of hair to a suction inlet.

It is yet another object of the invention to provide a device which decreases the time necessary for the permanent waving process.

These and other objects are accomplished by a water extraction device for use in conjunction with a perm rod disposed in a person's hair wherein the perm rod is at least partially surrounded by wet hair. The device includes a housing having an inlet and an outlet. The inlet defines a shroud that is especially dimensioned to closely encompass the perm rod, preferably in a manner that allows the inlet to press the wrapped hair against the rod, better to free the water trapped by surface tension in the hair. Proper fit of the shroud around the hair on a perm rod provides a narrow passageway through which air moves at a sufficient velocity to entrain excess liquid and to dry hair by evaporative removal of water as well. The shroud may be removably attached to the housing, and the shroud may be one from a group of different size shrouds suitable for encompassing different sizes of perm rods and/or perm rods which are wrapped by a greater or lesser quantity of hair (i.e., longer or shorter hair). The invention includes a pump connected for producing a substantial vacuum at the inlet and a flow of air and water from the inlet to the outlet. A motor is connected for operating the pump. The substantial vacuum produced by the pump moves air through the mass of hair, pulls water from the wet hair and transports the air and water toward the outlet. The device may also include a water separator for removing a majority of the water from the flow of air rather than emitting droplets into the ambient air. The water removed by the water separator can be collected in a tank or routed through a conduit for disposal down a plumbing system drain.

BRIEF DESCRIPTION OF THE DRAWINGS

There are shown in the drawings the embodiments of the invention that are presently preferred. It should be understood, however, that the invention is not limited to the precise arrangements and instrumentalities shown in the drawings, wherein.

DETAILED DESCRIPTION OF THE PREFERRED EMBODIMENTS

Figure 1:
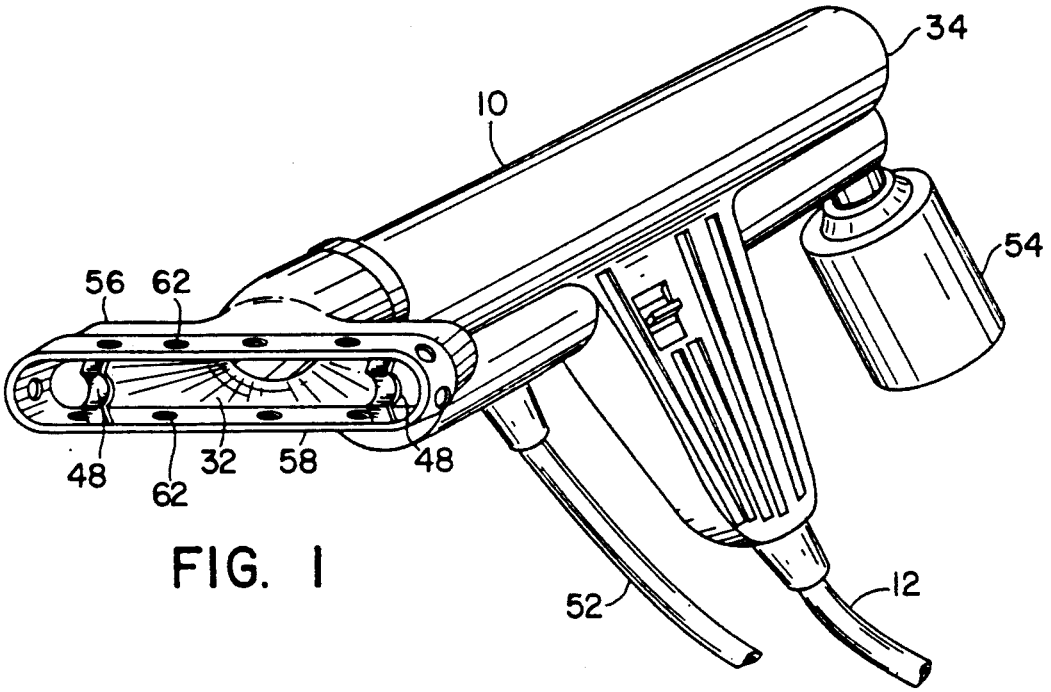
FIG. 1 is a perspective view of a water extraction device according to the invention.
Figure 2:
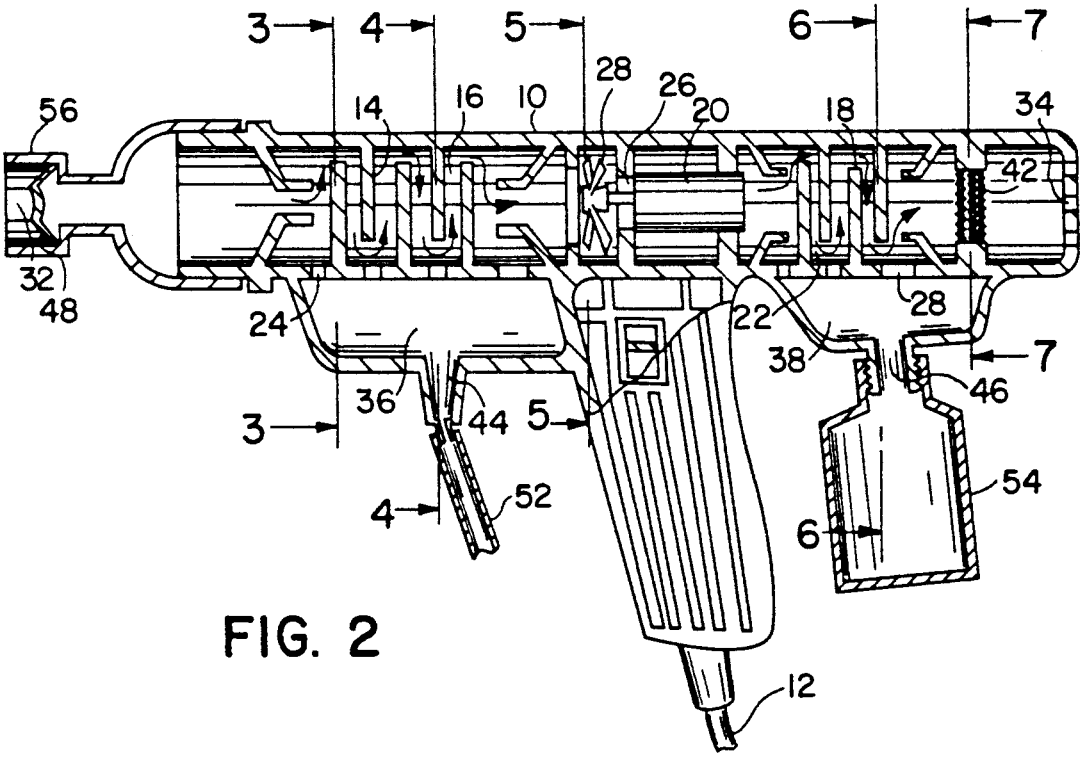
FIG. 2 is a side cross-sectional view of the water extraction device according to the invention.
Figure 8:
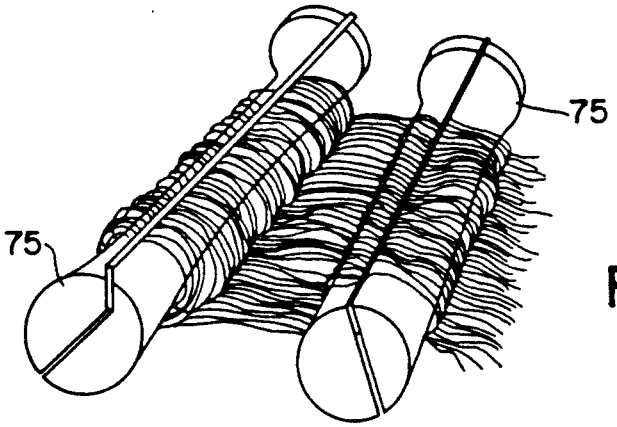
FIG. 8 is a perspective view of perm rods disposed in wet hair prior to application of the water extraction device according to the invention.
Figure 9:
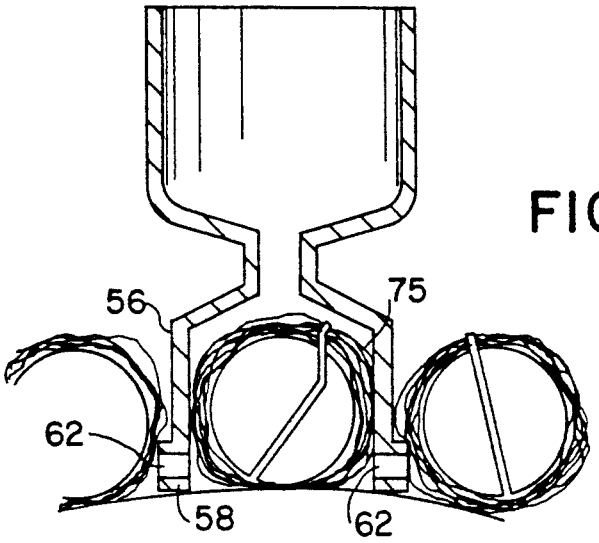
FIG. 9 is a cutaway view of an inlet shroud of the water extraction device disposed over a perm rod on a person's head.

A water extraction device according to the invention is used in conjunction with a perm rod, hair cutler or the like, disposed in a person's hair substantially as shown in FIG. 8. Referring to FIGS. 1 and 2, the water extraction device includes a housing 10 having an inlet 32 and an outlet 34. The inlet 32 defines a shroud 56 which is dimensioned to engage over the hair and perm rod embedded therein so as to define an air flow path which passes through the hair from an inlet point adjacent the scalp. In the embodiment shown, the shroud closely encompasses the perm rod 75, around which is wrapped wet hair, as shown more clearly in FIGS. 9 and 10. It will be clear that when the hair is wrapped on a perm rod, the respective strands of hair lie directly alongside one another, thereby defining capillary sized spaces which tend to hold water which would not be held if the hair strands were separated. Nevertheless, the perm process requires that the hair remain on the rods while being processed, in order to retain the curl or wave which the rod defines.

Referring again to FIGS. 1 and 2, the shroud 56 may be integral with the housing 10 or may be a separate removable and replaceable part which attaches to the housing 10 such as by a slight interference fit or a screw-on or snap-on connection. In order to closely encompass the typical perm rod as used on a person's head, the shroud 56 defines an opening which is substantially elongated in one direction, i.e., along the axis of the rod and the axis of the hair rolled thereon. As shown in FIGS. 1 and 2, the shroud 56 is substantially elongated in a direction which is perpendicular to a direction of airflow through the inlet 32. The shroud 56 preferably includes a partially deformable sealing ring 58 at the opening of the shroud which partially conforms to the person's head to increase the seal of the shroud around the perm rod and to provide better comfort for the person undergoing a water extraction procedure. The shroud 56 may include apertures 62 as necessary to permit a flow of air through the shroud as hereinafter more fully described. These apertures are positioned near the portion of the shroud residing adjacent the subject's scalp, and thus direct the air flow substantially through the mass of hair wrapped on the perm rod.

According to the invention, means are connected for producing a substantial vacuum at the inlet and a flow of air from the inlet 32 to the outlet 34. The means for producing a substantial vacuum may be, for example, a motor such as electric motor 20 supported within the housing 10 and having a rotatable shaft 26 coupled to a fan 28. Electrical power for the motor 20 is provided through power cord 12. The motor 20 rotates the fan 28 at a high speed, for example 3,600 revolutions per minute, thereby creating a high speed air flow from the inlet 32 through the interior of the housing 10 and discharging at the outlet 34. The high speed air flow provided by the fan 28 produces a substantial vacuum within the shroud 56 when the shroud is superposed over the perm rod 75 and the sealing ring 58 is disposed in contact with the person's head. The substantial vacuum within the shroud 56 pulls air through the hair and tends to entrain in the air flow the water from the wet hair around the perm rod 75. The flow of air transports the water toward the outlet 34.

Figure 10:
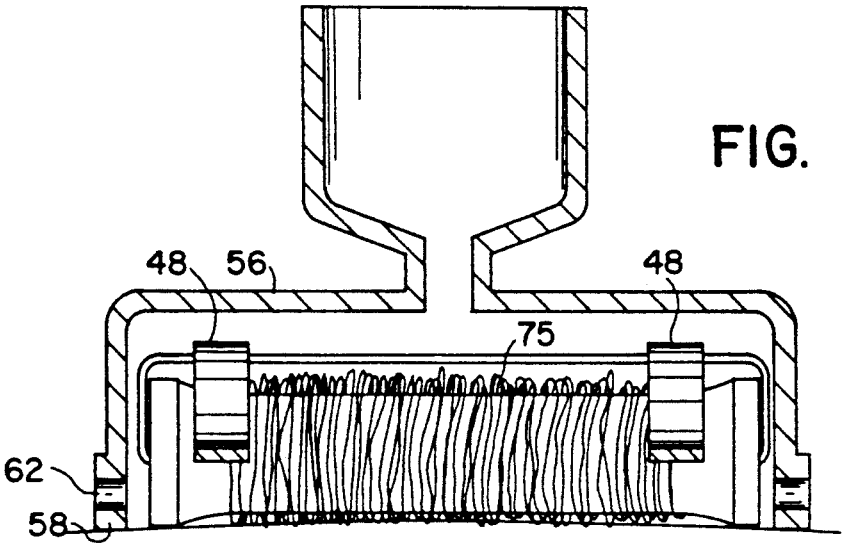
FIG. 10 is another cutaway view of the inlet shroud of the water extraction device disposed over a perm rod on a person's head.

Since perm rods come in a variety of sizes for producing different size curls in hair, it is preferred that the shroud 56 is selected from a group of different size shrouds each dimensioned to closely encompass a different size perm rod. The shroud 56 may include retainers 48 formed of a strip of spring steel, plastic or the like for holding the perm rod close to the person's head, as shown in FIG. 10, and preventing the perm rod from being pulled even a small amount into the shroud, which may be uncomfortable for the person. To some extent this structure also enables squeezing the hair against the perm rod to enhance the release of water. Frequently, perm rods, hair curlers and the like are made of a soft foam, and can be compressed readily. The operator proceeds from perm rod to perm rod until the water has been substantially removed from the subject's hair.

Figure 3:
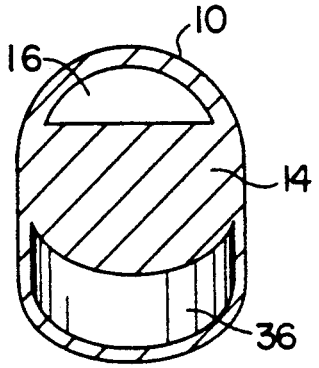
FIG. 3 is a cross-sectional view taken along line 3—3 of FIG. 2.
Figure 4:
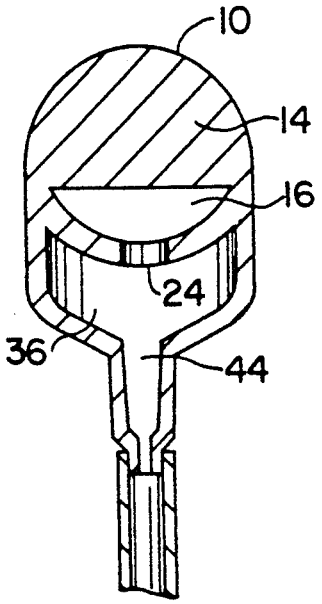
FIG. 4 is a cross-sectional view taken along line 4—4 of FIG. 2.
Figure 5:
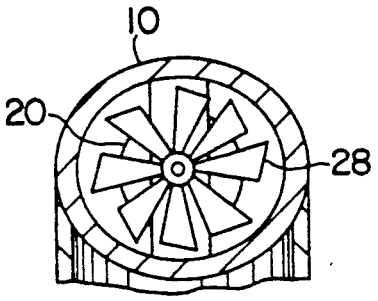
FIG. 5 is a cross-sectional view taken along line 5—5 of FIG. 2.
Figure 6:
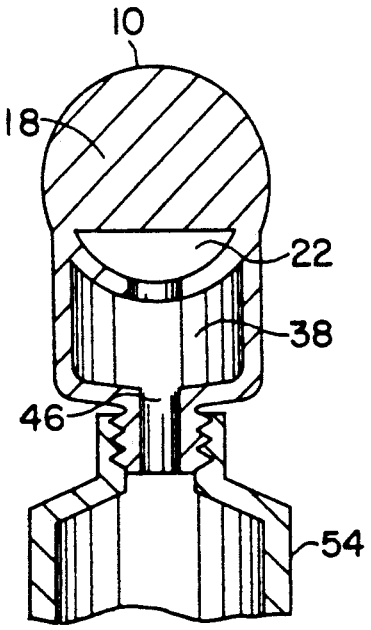
FIG. 6 is a cross-sectional view taken along line 6—6 of FIG. 2.
Figure 7:
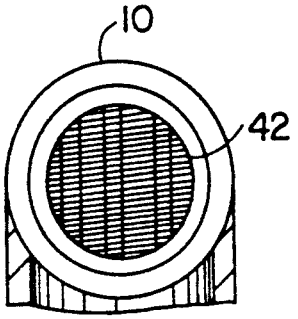
FIG. 7 is a cross-sectional view taken along line 7—7 of FIG. 2.

The invention provides water separator means for removing a substantial portion of the water from the flow of air. The water separator means preferably comprises a series of baffles within the interior of the housing 10. As shown in FIG. 2, forward baffles 14 are provided between the shroud 56 and the fan 28 for removing a majority of the water before it impinges on the fan. Rearward baffles 18 may also be provided if necessary for removing a further portion of water in the air which was not separated out by the forward baffles 14. The forward baffles 14 and the rearward baffles 18 may each be molded integrally with the housing 10, as shown more clearly in FIG. 3, 4 and 6. Each of the baffles 14, 18 defines a serpentine passageway 16, 22, respectively, for the air and water flowing within the interior of the housing 10. In the serpentine passageway 16, 22, the air and water is required to negotiate a series of sharp turns. Since entrained droplets of water have greater inertia than the air, it is more difficult for the water to negotiate the sharp turns at the high speed of the flowing air. The droplets impinge on the baffles and are thereby separated from the air, tending to flow downward by gravity, especially on the downstream faces of the upwardly protruding baffles, and on the upstream faces of the downwardly protruding baffles, where gravity flow is assisted by the following air flow. The separated water flows downwardly on the baffles to a lower wall of the housing and flows through openings 24, 28 into cavities 36, 38, respectively. Each of the cavities 36, 38 defines a sump for collecting the water separated from the air by the baffles 14, 18, in an area which is not exposed to substantial air flow which could re-entrain droplets. The cavities 36, 38 are each provided with an outlet 44, 46, respectively. The water collected in the cavities 36, 38 drains through the outlets 44, 46 to a water collecting means. The water collecting means may be, for example, a conduit 52 connected to the outlet 44 for communicating the water to a receiving means such as a tank rested on the floor, etc. Where the conduit 52 is located on the upstream side of the fan, it is desirable to use a sealed tank so that the vacuum on the upstream side does not oppose the flow of water toward the tank. Where a conduit is disposed on the downstream side of the fan, the conduit can lead to any drain, sink basin, plumbing fixture or the like, at regular atmospheric pressure.

In the embodiment shown, a water collecting means in the form of tank 54 is connected at the outlet 46 for accumulating and temporarily holding the water. The tank 54 is removably attached such as by a threaded connection to permit the tank 54 to be emptied periodically. It should be understood that the invention may include either one or both of the baffles 14, 18, and either one or more than one of the above described alternative embodiments for collecting and disposing of the water separated from the air flow within the housing 10. Other forms of water separators can also be used, for example as are used in pneumatic filters associated with compressed air supplies for painting and the like.

Where the air flow path is arranged such that the water extraction structures (e.g., baffles 14, 18) do not remove substantially all of the water droplets from the air flow, an absorbent pad, desiccant material and/or other water collection structure can be disposed at the outlet. To minimize condensation from the air flow being discharged through the outlet 34, a heating element such as electrical resistance heater 42 also may be provided near the outlet 34. The heater 42 increases the temperature of the air being discharged through the outlet 34, thereby increasing the capacity of the air to hold water vapor and lowering the relative humidity of the air. The heater 42 increases the likelihood that any water remaining in the discharged air will be in the form of water vapor instead of atomized droplets.

The invention has the advantage of enabling water to be removed from wet hair wrapped around a perm rod in a simple and efficient manner which is comfortable for the person undergoing a permanent waving procedure. The invention eliminates the necessity for blotting the hair with towels as a preliminary drying step, thereby reducing laundering expenses and reducing the volume of towels which must be handled and stored, while at the same time providing more even drying of the treated hair.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

I claim:

1. A water extraction device for use in conjunction with cylindrical hair styling accessories, wherein said cylindrical hair styling accessories are disposed in a person's hair and are at least partially surrounded by wet hair, the water extraction device comprising:

a hand-held, generally portable housing having an interior channel extending between an inlet and an outlet, the inlet defining a shroud dimensioned for closely encompassing a one of the cylindrical hair styling accessories, the outlet exhausting to a local atmosphere that generally surrounds the housing;

an electric motor mounted to said housing and a driven fan rotatably mounted within the channel at an intermediate station between the inlet and outlet, the motor and fan operably connected for driving the fan for producing a flow of an air-water mixture through the channel from the inlet to the outlet and producing a substantial vacuum at the inlet, the motor being interconnectable with an external power supply by a flexible line cord;

water separator means associated with the channel between the inlet and outlet for decreasing the water content in the air-water mixture;

the water separator means includes baffles extending partly across the channel to provide surfaces to which water can attach, said baffles being located between the inlet and the intermediate station for decreasing the water content in the flow of the air-water mixture to a selected level for passage across the intermediate station;

the electric motor is mounted within a moisture-proof enclosure within the channel; and, said baffles decreasing the water content in the flow of the air-water mixture to a selected amount suitable for passage across the moisture-proof enclosure.

2. The water extraction device of claim 1 wherein: the housing further defines a pistol grip for more convenient manipulation.

3. The water extraction device of claim 2, wherein: the pistol grip supports a contoller for manually operating the electric motor.

4. The water extraction device of claim 1, further comprising:

an electric resistance heater disposed across the channel adjacent the outlet for heating the flow of the air-water mixture for driving entrained water into vapor.

5. The water extraction device of claim 1, wherein: the housing is a molded plastic case.

6. A water extraction device for use in conjunction with cylindrical hair styling accessories, wherein said cylindrical hair styling accessories are disposed in a person's hair and are at least partially surrounded by wet hair, the water extraction device comprising:

a hand-held, generally portable housing having an interior channel extending between an inlet and an outlet, the inlet defining a shroud dimensioned for closely encompassing a one of the cylindrical hair styling accessories, the outlet exhausting to a local atmosphere that generally surrounds the housing;

an electric motor mounted to said housing and a driven fan rotatably mounted within the channel at an intermediate station between the inlet and outlet, the motor and fan operably connected for driving the fan for producing a flow of an air-water mixture through the channel from the inlet to the outlet and producing a substantial vacuum at the inlet, the motor being interconnectable with an external power supply by a flexible line cord;

water separator means associated with the channel between the inlet and outlet for decreasing the water content in the air-water mixture;

the water separator means includes baffles extending partly across the channel to provide surfaces to which water can attach, said baffles being located between the intermediate station and the outlet for decreasing the water content in the flow of the air-water mixture to a selected level for passage to the outlet;

an electric resistance heater disposed across the channel adjacent the outlet for heating the flow of the air-water mixture for driving entrained water into vapor;

the electric resistance heater including moisture-proofed electrical connections; and, said baffles decreasing the water content in the flow of the air-water mixture to a selected amount suitable for passage across the moisture-proofed electrical connections.

7. The water extraction device of claim 6, wherein:

the housing further defines a water collection reservoir including a drain that is shaped for releasably engaging a flexible conduit, said water collection reservoir associating with said water separator means for communicating water to the flexible conduit.

8. The water extraction device for claim 6, wherein:

the shroud comprises a central portion between a forward and rearward portion, the forward portion being dimensioned for closely encompassing a one of the hair styling accessories, the rearward portion defining a cylindrical constriction that merges with the channel as the rearward portion extends in the direction from the inlet to the outlet, and, the central portion defining a convergent section from the forward to the rearward portion.

* * * * *